US010837084B2

(12) United States Patent
Horikawa et al.

(10) Patent No.: US 10,837,084 B2
(45) Date of Patent: Nov. 17, 2020

(54) MOLTEN SALT ELECTROLYZER, AND METHOD FOR PRODUCING METAL MAGNESIUM USING THE SAME AND METHOD FOR PRODUCING A TITANIUM SPONGE

(71) Applicant: TOHO TITANIUM CO., LTD., Kanagawa (JP)

(72) Inventors: Matsuhide Horikawa, Kanagawa (JP); Daisuke Suzuki, Kanagawa (JP)

(73) Assignee: TOHO TITANIUM CO., LTD., Kanagawa (JP)

( * ) Notice: Subject to any disclaimer, the term of this patent is extended or adjusted under 35 U.S.C. 154(b) by 371 days.

(21) Appl. No.: 15/741,197

(22) PCT Filed: Jul. 27, 2016

(86) PCT No.: PCT/JP2016/071985
§ 371 (c)(1),
(2) Date: Dec. 29, 2017

(87) PCT Pub. No.: WO2017/018441
PCT Pub. Date: Feb. 2, 2017

(65) Prior Publication Data

US 2018/0195151 A1 Jul. 12, 2018

(30) Foreign Application Priority Data

Jul. 28, 2015 (JP) ..... 2015-148820

(51) Int. Cl.
*C25C 3/00* (2006.01)
*C22B 26/22* (2006.01)
(Continued)

(52) U.S. Cl.
CPC ..... *C22B 26/22* (2013.01); *C22B 5/04* (2013.01); *C22B 34/12* (2013.01);
(Continued)

(58) Field of Classification Search
CPC .. C25C 3/04; C25C 7/005; C25C 3/00; C25C 7/025; C25C 3/08; C25C 7/00
See application file for complete search history.

(56) References Cited

U.S. PATENT DOCUMENTS 4,514,269 A 4/1985 Sivilotti
4,604,177 A 8/1986 Sivilotti
(Continued)

FOREIGN PATENT DOCUMENTS

CN 1073171 C 10/2001
CN 102206839 A 10/2011
(Continued)

OTHER PUBLICATIONS

Notification of Transmittal of Translation of the International Preliminary Report on Patentability and Translation of Written Opinion of the International Searching Authority issued in PCT/JP2016/071985; dated Feb. 8, 2018.
(Continued)

*Primary Examiner* — Zulmariam Mendez
(74) *Attorney, Agent, or Firm* — Studebaker & Brackett PC

(57) ABSTRACT

A molten salt electrolyzer having a metal collection chamber, an electrolysis chamber, and two or more electrolytic cell units positioned in the electrolysis chamber. Each electrolytic cell unit has a cathode having an inner space in a prism form; at least one bipolar electrode in a rectangular cylinder form and disposed in the cathode inner space; and an anode in a prism form and disposed in an inner space of the bipolar electrode. At least part of individual planes forming an outer side of the bipolar electrode closest to the cathode faces a plane forming the prism-form inner space of the cathode. At least part of individual planes forming the inner side of the bipolar electrode closest to the anode faces a plane forming the prism of the anode. At least one plane
(Continued)

of the cathode constitutes one plane of a cathode of another electrolytic cell unit.

7 Claims, 5 Drawing Sheets

(51) Int. Cl.

| | |
|---|---|
| ***C25C 3/04*** | (2006.01) |
| ***C22B 34/12*** | (2006.01) |
| ***C25C 7/02*** | (2006.01) |
| ***C25C 7/00*** | (2006.01) |
| ***C22B 5/04*** | (2006.01) |

(52) U.S. Cl.
CPC ..... *C22B 34/1272* (2013.01); *C25C 3/04* (2013.01); *C25C 7/005* (2013.01); *C25C 7/02* (2013.01); *C25C 7/025* (2013.01)

(56) References Cited

U.S. PATENT DOCUMENTS

| | | | | |
|---|---|---|---|---|
| 5,368,702 | A | 11/1994 | de Nora | |
| 2008/0087139 | A1* | 4/2008 | Spachner | C22B 34/1272 75/620 |
| 2013/0032487 | A1 | 2/2013 | Sivilotti | |

FOREIGN PATENT DOCUMENTS

| | | | |
|---|---|---|---|
| JP | S59-043890 | A | 3/1984 |
| JP | H11-503794 | A | 3/1999 |
| JP | 2005-171354 | A | 6/2005 |
| JP | 2012-149301 | A | 8/2012 |
| JP | 2012-251221 | A | 12/2012 |
| RU | 2101392 | C1 | 1/1998 |
| UZ | 02631 | C | 4/2005 |

OTHER PUBLICATIONS

International Search Report issued in PCT/JP2016/071985; dated Oct. 18, 2016.

An Office Action mailed by the Russian Patent and Trademark Office dated Nov. 2, 2018, which corresponds to Russian Patent Application No. 2018107106 and is related to U.S. Appl. No. 15/741,197.

Search Report mailed by the Russian Patent and Trademark Office on Nov. 2, 2018, which corresponds to Russian Patent Application No. 2018107106 and is related to U.S. Appl. No. 15/741,197.

An Office Action mailed by the China National Intellectual Property Administration dated Nov. 2, 2018, which corresponds to Chinese Patent Application No. 201680044048.X and is related to U.S. Appl. No. 15/741,197.

* cited by examiner

MOLTEN SALT ELECTROLYZER, AND METHOD FOR PRODUCING METAL MAGNESIUM USING THE SAME AND METHOD FOR PRODUCING A TITANIUM SPONGE

TECHNICAL FIELD

The present invention relates to a molten salt electrolyzer comprising two or more electrolytic cells, and a method for producing metal magnesium using the same as well as a method for producing a titanium sponge.

BACKGROUND ART

A molten salt electrolyzer, particularly a molten salt electrolyzer which produces metal magnesium from magnesium chloride is used for regenerating metal magnesium used as a reducing agent in the production of a titanium sponge by a Kroll method. Specifically, in the production of a titanium sponge by a Kroll method, titanium ore is chlorinated to form titanium tetrachloride, and the titanium tetrachloride is reduced using magnesium to produce a titanium sponge. Magnesium chloride, which is by-produced in the reduction reaction, is changed by fused salt electrolysis back to metal magnesium, which is reused as a reducing agent.

As a molten salt electrolyzer of this type, generally, there are used those which have, in an electrolysis chamber, an anode and a cathode in a flat plate form or a bipolar electrode disposed between the anode and the cathode (for example, PTLs 1 and 2). There have also been proposed an electrolytic cell having a plurality of cells incorporated thereinto wherein each cell is a cylindrical multiple-electrode which has a bipolar electrode and a cathode in a cylinder form arranged so that they surround an anode as a center (PTL 3), and an electrolytic cell having a plurality of cells incorporated thereinto wherein each cell is a rectangular cylindrical multiple-electrode which has electrodes in a rectangular cylinder form instead of the above electrodes in a cylinder form (PTL 4).

However, the electrolytic cell having electrodes in a flat plate form has problems of low current efficiency and low purity of produced metal, which are occurred by the contamination of produced metal from impurities caused by reaction between the metal produced and inner wall materials, and by the damage due to electrochemical corrosion or the like of inner wall materials forming electrolytic cell through conducting electrolysis. On the other hand, the electrolytic cell having incorporated cylindrical or rectangular cylindrical multiple-electrodes has problems, for example, in that a waste space is caused between a cell and the electrolytic cell wall or between a cell and another one, so that the productivity for metal magnesium per unit volume is poor.

CITATION LIST

Patent Literature

[PTL 1] JP-A-2012-149301

[PTL 2] JP-A-2005-171354

[PTL 3] JP-A-11-503794

[PTL 4] U.S. Patent Application No. 2013/0032487

SUMMARY OF INVENTION

Technical Problem

The present invention solves the above-mentioned problems, and a task of the invention is to provide a molten salt electrolyzer and a method for producing metal magnesium, which can further improve the current efficiency and improve the productivity for metal per unit volume of the electrolytic cell, and which can further produce metal magnesium of higher purity, and provide a method for producing a titanium sponge. Specifically the reduction of titanium tetrachloride using metal magnesium of high purity bring the produced titanium sponge higher purity.

Solution to Problem

As means for solving the above-mentioned problems, the present invention is as follows.

[1] A molten salt electrolyzer having two or more electrolytic cell units in an electrolysis chamber, wherein each electrolytic cell unit has a cathode having a space in a prism form, an anode in a prism form, and at least one bipolar electrode in a rectangular cylinder form, wherein the bipolar electrode is disposed in the inner space of the cathode, and the anode is disposed in the inner space of the bipolar electrode, wherein at least part of the individual planes forming the outer side of the rectangular cylinder of the bipolar electrode closest to the cathode faces the plane forming the prism-form space of the cathode, wherein at least part of the individual planes forming the inner side of the rectangular cylinder of the bipolar electrode closest to the anode faces the plane forming the prism of the anode, and wherein at least one plane of the cathode constitutes one plane of the cathode of another electrolytic cell unit.

[2] The molten salt electrolyzer according to item [1] above, wherein at least one of the distance between the cathode plane on the side opposite to the metal collection chamber and the bipolar electrode plane closest to the cathode plane, the distance between the bipolar electrode plane on the side opposite to the metal collection chamber and another bipolar electrode plane closest to the bipolar electrode plane, and the distance between the bipolar electrode plane on the side opposite to the metal collection chamber and the anode plane closest to the bipolar electrode plane is shorter than the distance between the corresponding cathode plane on the metal collection chamber side and the bipolar electrode plane closest to the cathode plane, the distance between the corresponding bipolar electrode plane on the metal collection chamber side and another bipolar electrode plane closest to the bipolar electrode plane, or the distance between the corresponding bipolar electrode plane on the metal collection chamber side and the anode plane closest to the bipolar electrode plane.

[3] The molten salt electrolyzer according to item [1] or [2] above, wherein the anode of the electrolytic cell unit is disposed so that the ratio of the distance from the center portion of the anode to the cathode plane on the side opposite to the metal collection chamber and the distance from the center portion of the anode to the cathode plane on the metal collection chamber side is 1:0.5 to 1:2.

[4] The molten salt electrolyzer according to any one of items [1] to [3] above, wherein the anode has a horizontal cross-section in which the ratio of the long side and the short side is 1:1 to 20:1.

[5] A method for producing metal magnesium, which comprises subjecting magnesium chloride to fusion electrolysis using the molten salt electrolyzer according to any one of items [1] to [4] above to produce metal magnesium.

[6] A method for producing a titanium sponge, which comprises reducing titanium tetrachloride using the metal magnesium obtained by the method according to item [5] above to produce a titanium sponge.

Advantageous Effects of Invention

The molten salt electrolyzer of the present invention has an improved current efficiency, and therefore can drastically reduce the production cost for metal and increase the productivity for metal per unit volume, and thus exhibits advantageous effects such that the electrolytic cell can be compact, and further it is possible to efficiently produce metal magnesium as well as a titanium sponge at a low cost.

DESCRIPTION OF EMBODIMENTS

Figure 1:
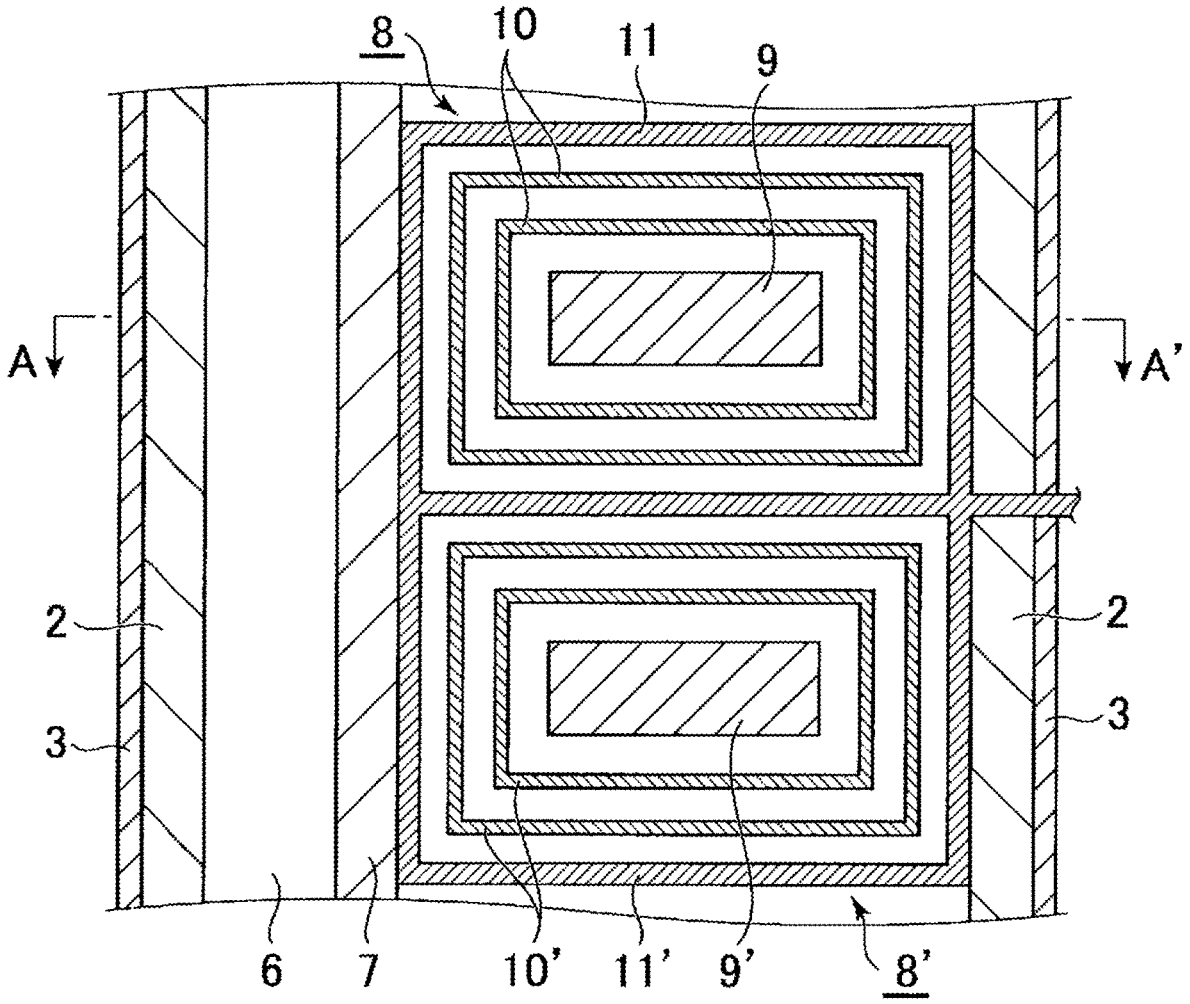
FIG. 1 is an explanatory view showing a horizontal cross-section of a molten salt electrolyzer according to an embodiment of the invention.

The molten salt electrolyzer of the invention has an electrolysis chamber for conducting electrolysis and a metal collection chamber for recovering a metal obtained by the electrolysis, and has between the metal collection chamber and the electrolysis chamber a barrier having an opening. Two or more electrolytic cell units are provided in the electrolysis chamber. In each electrolytic cell unit, an anode in a prism form is disposed near the center of the cell unit, and at least one bipolar electrode in a rectangular cylinder form and a cathode are arranged so that they surround the anode, and the space defined by the bipolar electrode and cathode is in a prism form, and at least one plane of the cathode constitutes one plane of the cathode of another or other adjacent electrolytic cells. By virtue of this, both surfaces of the cathode plate of the electrolytic cell can be used for electrolysis, enabling effective utilization of the limited space. Further, because the molten salt electrolysis is performed in the space defined by the cathode, it is possible to reduce the reaction between the metal produced and inner wall materials or barrier materials, and also the damage of the inner wall materials forming the electrolytic cell through conducting electrolysis, which bring the molten salt electrolyzer long life and produced metal high purity. Furthermore, the cathodes of the individual electrolytic cell units are electrically conducted to each other, making it possible to simplify wire connections to the cathodes.

With respect to the electrodes in the invention, the form of the horizontal cross-section is a square, a rectangle, or a polygon, the three-dimensional shape of the anode is a cube, a parallelepiped, or a polygonal cylinder, and the three-dimensional shape of the bipolar electrode and cathode is a cylindrical form of the above shape. Those having a horizontal cross-section the form of which is a square or a rectangle are preferred because they are easy to assemble and the processing cost for them is small. Those having a horizontal cross-section the form of which is a rectangle are more preferred because the current efficiency is high and it is possible to increase the electrolysis area.

A chamfered portion may be formed at the corner portions of these electrodes.

Further, for achieving efficient recovery of a metal, it is preferred that two or more electrolytic cell units are arranged along the direction of the metal collection chamber.

In the invention, as viewed on the horizontal cross-section, the anode is disposed near the center of the space surrounded by the bipolar electrode or cathode. The anode is preferably disposed to be shifted from the middle of the space surrounded by the cathode to the side opposite to the metal collection chamber (hereinafter, frequently referred to as "electrolytic cell rear-wall side"). By virtue of this, the distance between the electrodes on the electrolytic cell rear-wall side is shorter than the distance between the electrodes on the metal collection chamber side, so that the current density of the electrodes having a shorter distance therebetween is increased, resulting in a vigorous electrolysis reaction in the electrolytic bath. A large amount of gas and a metal generated due to the vigorous electrolysis have a specific gravity smaller than that of the electrolytic bath, and hence rise between the electrodes more vigorously than those between the electrodes on the metal collection chamber side, and then flow into the metal collection chamber. Consequently, an apparent density difference is caused, and a fast bath flow moving counter-clockwise is generated in the molten salt electrolyzer. The generation of a fast bath flow causes the metal formed in the electrolysis chamber to be rapidly transferred to the metal collection chamber, making it possible to prevent the metal from retaining. Further, it is possible to prevent the metal from further reacting with chlorine generated between the electrodes (to control the electrolytic bath).

In this case, it is more preferred that the electrodes are arranged so that at least one of the distance between the cathode plane on the side opposite to the metal collection chamber, namely, on the electrolytic cell rear-wall side and the bipolar electrode plane closest to the cathode plane, the distance between the bipolar electrode plane on the electrolytic cell rear-wall side and another bipolar electrode plane closest to the bipolar electrode plane, and the distance between the bipolar electrode plane on the electrolytic cell rear-wall side and the anode plane closest to the bipolar electrode plane is shorter than the distance between the corresponding cathode plane on the metal chamber side and the bipolar electrode plane closest to the cathode, the distance between the corresponding bipolar electrode plane on the metal collection chamber side and another bipolar electrode plane closest to the bipolar electrode plane, or the distance between the corresponding bipolar electrode plane on the metal collection chamber side and the anode plane closest to the bipolar electrode plane. The reason for this is that the bath flow in the electrolysis chamber is improved, so that the occurrence of a further reaction of the gas and metal between the electrodes after the electrolysis is prevented, making it possible to improve the current efficiency.

The above arrangement of the electrodes can be achieved by a method, for example, in which one of or both of the anode and the bipolar electrode are shifted to the electrolytic cell rear-wall side, or the thickness of one of or both of the bipolar electrode plane and the cathode plane on the electrolytic cell rear-wall side is increased so that the individual distance between the electrodes is reduced.

In this case, particularly, it is more preferred that the distance between the cathode plane on the electrolytic cell rear-wall side and the bipolar electrode plane closest to the cathode plane is shorter than the distance between the cathode plane on the metal collection chamber side and the bipolar electrode plane closest to the cathode plane. Further, it is preferred that the anode of the electrolytic cell unit is disposed so that the ratio of the distance from the center portion of the anode to the cathode plane on the electrolytic cell rear-wall side and the distance from the center portion of the anode to the cathode plane on the metal collection chamber side is 1:0.5 to 1:2, more preferably 1:0.5 to 1:1.8, further preferably 1:0.5 to 1:1.5.

With respect to the material for the anode, graphite is preferred. With respect to the size of the anode, the long side in the direction of the electrolytic cell rear-wall side and metal collection chamber side (electrolytic cell lengthwise direction) is 40 to 90% of the electrolytic cell unit, and the short side in the direction perpendicular to the long side (electrolytic cell crosswise direction) as viewed on the plane is 10 to 100% of the long side, and the anode has a horizontal cross-section in which the ratio of the long side and the short side is 1:1 to 10:1, and has a height which is 20 to 70% of the height of the electrolytic bath, and the upper end of the cathode is preferably disposed to be lower than the electrolytic bath level.

The cathode in the invention is arranged so as to surround the anode, but may surround a part of the anode, and is preferably arranged so as to surround the lower portion of the anode positioned below the through-hole portion in the barrier between the metal collection chamber and the electrolysis chamber.

With respect to the material for the cathode, iron or graphite is preferred, and iron is more preferred. When iron is used, the cathode may be produced from a single plate of iron, but, taking thermal expansion into consideration, the cathode may be produced from a combination of a plurality of plates of iron.

It is preferred that one side of the cathode is disposed on the electrolytic cell rear wall portion and the other side of the cathode is disposed on the barrier.

The sizes of the cathode in its lengthwise direction (which is the same direction as the electrolytic cell lengthwise direction) and crosswise direction (which is the same direction as the electrolytic cell crosswise direction) determine the size of the electrolytic cell unit, and it is preferred that the size of the cathode in the lengthwise direction is the same as the distance between the electrolytic cell rear wall portion and the barrier, the size of the cathode in the crosswise direction is 10 to 100% of the size of the cathode in the lengthwise direction, and, with respect to the size in the depth direction, the lower end of the cathode is at the same level as the lower end of the anode or higher than the lower end of the anode, and the cathode has a height such that the upper end of the cathode does not protrude from the bath level. Further, the thickness of the cathode is preferably smaller for achieving a more excellent flow in the electrolytic bath, but the thickness of the cathode is preferably 3 to 10 cm for the necessity of maintaining the strength.

The bipolar electrode in the invention is disposed between the anode and the cathode so as to surround the anode, but may be able to surround a part of the anode. Further, the bipolar electrode preferably has a height such that the fused salt can go beyond the upper portion of the bipolar electrode, and the height of the bipolar electrode is preferably higher than the upper end of the cathode and lower than the lower surface of the top cover.

At least one bipolar electrode is incorporated, two bipolar electrodes are preferably incorporated, and three or more bipolar electrodes are more preferably incorporated.

With respect to the material for the bipolar electrode, graphite is preferred, and the bipolar electrode may be produced from a single plate of graphite, but, taking thermal expansion into consideration, the bipolar electrode may be produced from a combination of a plurality of plates of graphite. One surface of the bipolar electrode may be subjected to steel liner processing.

The thickness of the bipolar electrode(s) varies depending on the number of the bipolar electrode (s) incorporated, and is preferably selected so that the gaps between the anode and the bipolar electrode closest to the anode, between the bipolar electrode and another bipolar electrode closest to the bipolar electrode, and between the bipolar electrode and the cathode closest to the bipolar electrode are equal in the lengthwise direction of the electrolytic cell unit. The thickness of the bipolar electrode is preferably 3 to 10 cm.

The materials for the inner wall and barrier in the invention are preferred to be difficult to react with metal produced, and not to react with molten salt, to be highly tolerable against the corrosion of chlorine. Any traditional inner wall materials for the use of molten salt electrolyzer can be used. Specifically bricks consisted of following brick are preferred, such as brick having an $Al_2O_3$ content of 90% or more, brick having a $SiO_2$ content of 90% or more, brick having a $Si_3N_4$ content of 90% or more, brick having a MgO content of 90% or more, brick having $Al_2O_3$ and $SiO_2$ content of 90% or more, brick having the combination of at least two of $Al_2O_3$, $SiO_2$, $Si_3N_4$ and MgO content of 90% or more, and more preferably bricks having an $Al_2O_3$ content of 90% or more, bricks having $Al_2O_3$ and $SiO_2$ content of 90% or more, bricks having an $Al_2O_3$ content of 95% or more, bricks having a $Si_3N_4$ content of 90% or more, bricks having $Al_2O_3$ and $SiO_2$ content of 95% or more, and further preferably bricks having an $Al_2O_3$ content of 90% or more, especially bricks having an $Al_2O_3$ content of 95% or more, brick having $Al_2O_3$ and $SiO_2$ content of 95% or more.

Components made up the bricks are measured in accordance with JIS 8856:1998.

An embodiment of the molten salt electrolyzer of the invention is described with reference to FIGS. 1 to 3.

Figure 2:
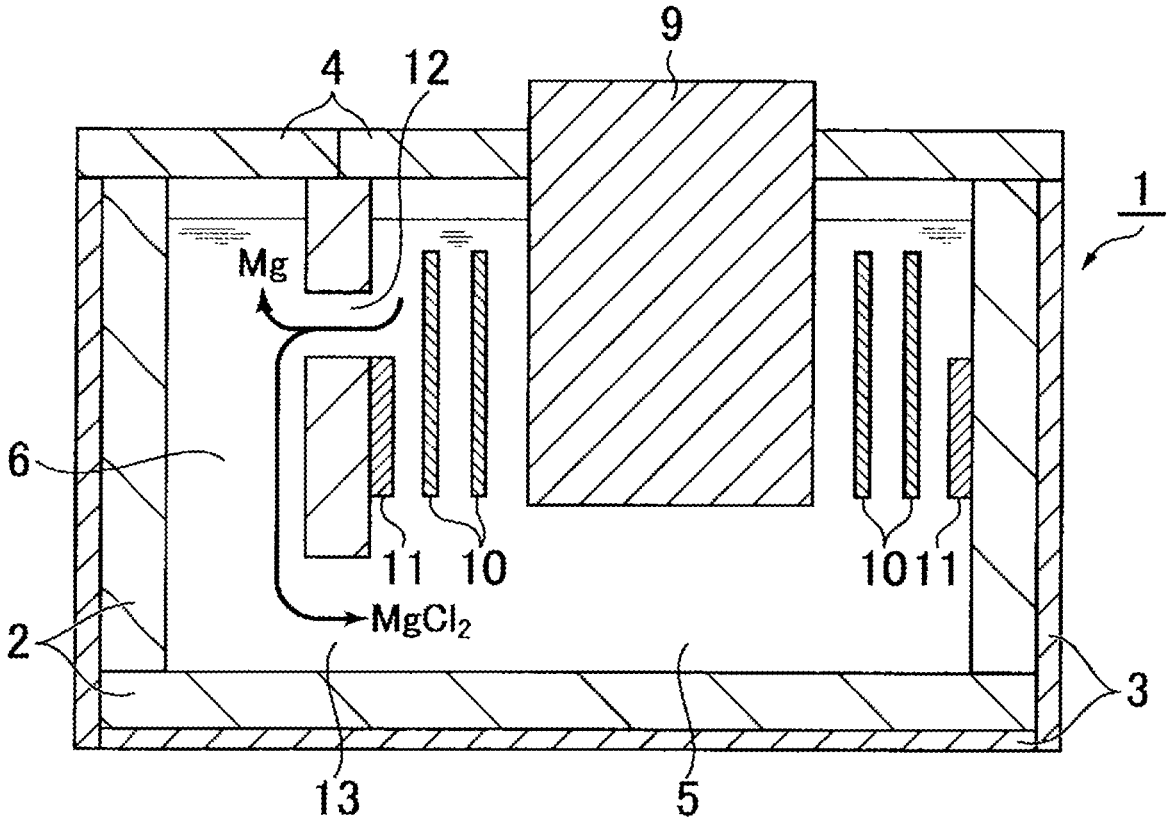
FIG. 2 is an explanatory view showing a vertical cross-section of a molten salt electrolyzer according to an embodiment of the invention.
Figure 3:
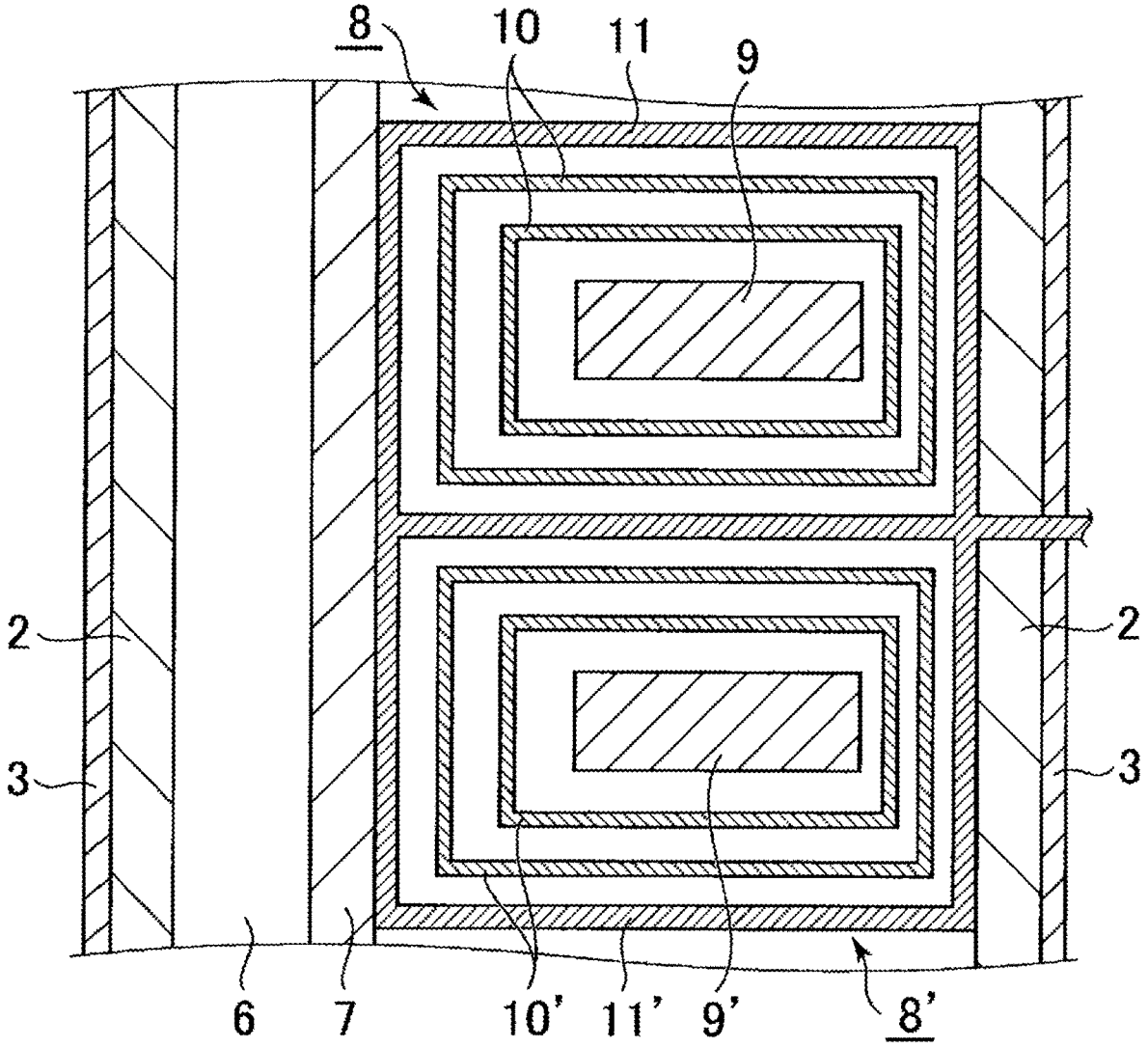
FIG. 3 is an explanatory view showing another embodiment of FIG. 1.

FIG. 1 is an explanatory view showing a horizontal cross-section of the molten salt electrolyzer, FIG. 2 is an explanatory view showing a vertical cross-section, taken along the line A-A' of FIG. 1, and FIG. 3 is an explanatory view showing another embodiment of FIG. 1.

As shown in FIG. 2, a body of the molten salt electrolyzer 1 has an inner wall 2 made of refractory brick and an outer wall 3 made of insulating brick, and the upper portion of the body is covered with a top cover 4. The molten salt electrolyzer 1 has an electrolysis chamber 5 for conducting electrolysis and a metal collection chamber 6 for recovering a metal obtained by the electrolysis, and a barrier 7 is formed between the electrolysis chamber 5 and the metal collection chamber 6.

In the electrolysis chamber 5, as shown in FIG. 1, a plurality of (two in FIG. 1) electrolytic cell units 8, 8' are arranged in the direction parallel to the metal collection chamber 6, anodes 9, 9' in a prism form are disposed near the respective centers of the electrolytic cell units 8, 8', and a plurality of (two in FIG. 1) bipolar electrodes 10, 10' in a rectangular cylinder form and one cathode 11, 11' are arranged so as to surround the anodes 9, 9', and the space defined by the bipolar electrodes 10, 10' and cathode 11, 11' is in a prism form.

One plane of the cathode 11, 11' constitutes one plane of the cathode of the adjacent electrolytic cell, and the cathodes of the individual electrolytic cells are electrically conducted to each other.

On the other hand, it is preferred that, as shown in FIG. 2, a through-hole 12 which allows both the electrolysis chamber and metal collection chamber to communicate with each other is formed in the barrier 7 formed between the electrolysis chamber 5 and the metal collection chamber 6 wherein the position of the through-hole formed is the upper portion of the barrier and is below the surface of the electrolytic solution, and that the lower end of the barrier 7 is fixed onto the brick having an opening at the bottom of the molten salt electrolyzer 1, and an opening portion 13 which allows the electrolysis chamber 5 and metal collection chamber 6 to communicate with each other is formed.

The anode 9 penetrates the top cover 4 of the electrolysis chamber 5 and protrudes from the top cover, and the cathode 11 is disposed so that the upper end of the cathode is at a level the same as or lower than the lower side of the through-hole 12 in the barrier 7. The bipolar electrode 10 is disposed so as to have a height such that the upper end of the bipolar electrode is higher than the upper side of the through-hole 12 and the electrolytic bath can go beyond the bipolar electrode upon running the molten salt electrolyzer. The lower ends of the anode 9, bipolar electrode 10, and cathode 11 are disposed so as to be higher than the upper end of the opening portion 13 which allows the electrolysis chamber 5 and metal collection chamber 6 to communicate with each other.

The anode and cathode pair are connected to a not shown direct current power source.

Further, FIG. 3 shows another embodiment of the molten salt electrolyzer, in which the anodes 9, 9' and bipolar electrodes 10, 10' are shifted from the middle of the space surrounded by the cathodes 11, 11' to the electrolytic cell rear-wall side.

With respect to the metal to be produced by the molten salt electrolyzer of the invention, there is no particular limitation as long as fused salt electrolysis can be made, but metal magnesium, metal aluminum, metal calcium, or metal zinc is preferred, and metal magnesium is especially preferred.

Next, an explanation is made on an embodiment in which metal magnesium is produced by fused salt electrolysis using the molten salt electrolyzer 1 of the invention.

In FIG. 2, in the molten salt electrolyzer 1, heat melted magnesium chloride is introduced from a not shown raw material feed inlet so that the electrolytic bath level is kept higher than the through-hole 12 in the barrier 7.

Upon running the molten salt electrolyzer, an electrolysis current flows from the anode 9 through the bipolar electrode 10 to the cathode 11, and magnesium chloride is electrolyzed between the electrodes to form metal magnesium as well as chlorine gas. The chlorine gas rises through the electrolytic bath to generate a flow of circulation in the electrolytic bath. The flow of circulation causes the metal magnesium formed at the cathode to be transferred through the through-hole 12 in the barrier 7 to the metal collection chamber 6, and the metal magnesium collects onto the surface of the metal collection chamber 6 due to a difference in specific gravity between the metal magnesium and the electrolytic bath, and is recovered through a not shown metal recovery port, thus producing metal magnesium.

On the other hand, the generated chlorine gas collects in the upper space of the electrolysis chamber 5, and is recovered through a not shown chlorine recovery port.

The metal magnesium obtained using the molten salt electrolyzer of the invention can be used for reducing titanium tetrachloride in the reduction step which is one step of the production process for a titanium sponge. And the reduction of titanium tetrachloride using metal magnesium of high purity bring the produced titanium sponge higher purity.

Specifically, the production process for a titanium sponge includes a step for chlorinating titanium ore to produce titanium tetrachloride, a step for reducing the titanium tetrachloride using magnesium to produce a titanium sponge, and further a step for subjecting the resultant titanium sponge to crushing and particle size selection to produce a product titanium sponge and a step for subjecting magnesium chloride by-produced in the reduction of titanium tetrachloride with magnesium to fused salt electrolysis to by-produce metal magnesium and chlorine gas {see, for example, "Production of metal titanium in Toho Titanium Co., Ltd.", Journal of MMIJ Vol. 123, P693-697 (2007)}.

By incorporating the molten salt electrolyzer of the invention into the above fusion electrolysis step, a titanium sponge can be efficiently produced at a low cost.

EXAMPLES

In the following Examples and Comparative Examples, the production cost was evaluated from a current efficiency. The current efficiency is used as an index, by which a ratio of the amount of the current used for the electrolysis to the amount of the current which has flowed can be known, and which indicates that the higher the current efficiency, the lower the production cost.

The current efficiency can be determined by calculation using the following formula.

(Current efficiency)=(Mass of metal magnesium recovered from the electrolytic cell)/(Mass of metal magnesium theoretically formed)

In the above formula, the mass of metal magnesium recovered from the electrolytic cell means a mass of metal magnesium recovered from the top portion of the metal collection chamber of FIG. 2 (hereinafter, referred to as "actual production amount"), and the mass of metal magnesium theoretically formed means a mass of metal magnesium formed when the current which has flowed is used for the electrolysis of magnesium chloride without any loss of the current (hereinafter, referred to as "theoretical production amount").

In the following examples, the mass of metal magnesium is measured in the electrolytic cell which is formed from the inner walls consist of the bricks having an $Al_2O_3$ 95% or more. However the bricks of the invention can be made from any materials which can be mixed into the metal produced, and especially not to be restricted to bricks having an $Al_2O_3$ content of 95% or more.

Example 1

As shown in FIG. 1, two electrolytic cell units were disposed in the molten salt electrolyzer having a 2 $m^3$ electrolysis chamber and a 0.5 $m^3$ metal collection chamber shown in FIG. 2, and 2,900 kg of a fused salt comprising $MgCl_2$, $CaCl_2$, NaCl, and $MgF_2$ in the respective mass percentages of 20%, 30%, 49%, and 1% was introduced into the molten salt electrolyzer. Magnesium chloride in an appropriate amount corresponding to the production amount of metal magnesium was charged into the electrolytic cell to perform fused salt electrolysis at an average current density set to 0.48 $A/cm^2$. In this instance, the amount of the current which had flowed was 16.0 kA, and hence the theoretical production amount is 21.8 kg/h. However, the actual production amount was 18.5 kg/h, and therefore the current efficiency of the molten salt electrolyzer was 85%. The production amount per unit volume of the electrolysis chamber was 9.3 $kg/m^3 \cdot h$.

Example 2

Using substantially the same molten salt electrolyzer and fused salt as in Example 1 except that, as shown in FIG. 3, the electrolytic cells were disposed so that the center positions of the anode and bipolar electrode were shifted to the electrolytic cell rear-wall side by 5 mm, fused salt electrolysis was performed at an average current density of 0.48 $A/cm^2$. In this instance, the amount of the current which had flowed was 16.0 kA, and hence the theoretical production amount is 21.8 kg/h. However, the actual production amount was 18.9 kg/h, and therefore the current efficiency of the molten salt electrolyzer was 87%. The production amount per unit volume of the electrolysis chamber was 9.5 $kg/m^3 \cdot h$.

Comparative Example 1

Figure 4:
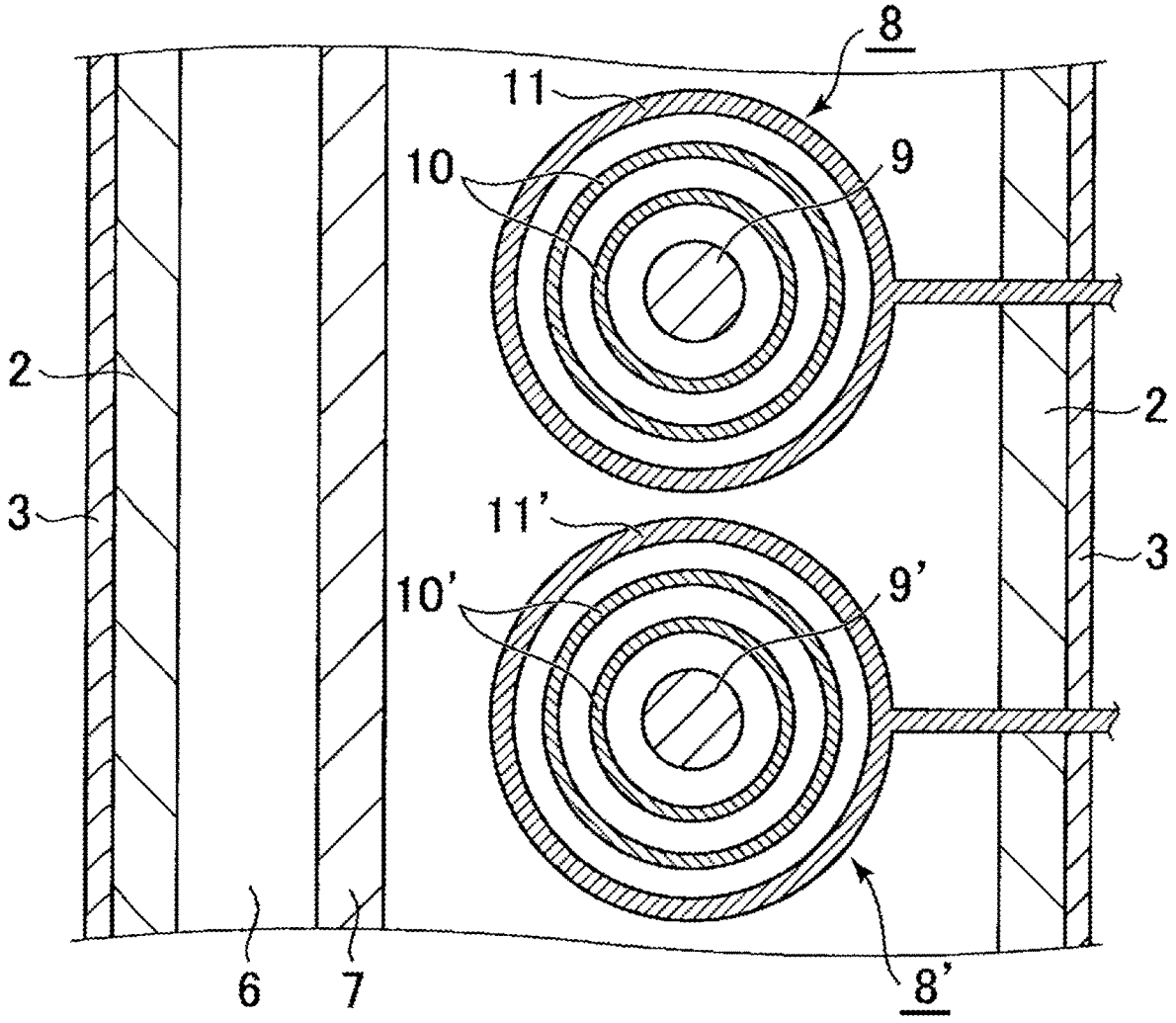
FIG. 4 is an explanatory view showing a horizontal cross-section of a molten salt electrolyzer used as a Comparative Example, which has disposed therein electrolytic cells arranged in concentric circles.

As shown in FIG. 4, two electrolytic cell units arranged in concentric circles were disposed in the molten salt electrolyzer shown in FIG. 2, and 3,100 kg of a fused salt comprising $MgCl_2$, $CaCl_2$, NaCl, and $MgF_2$ in the respective mass percentages of 20%, 30%, 49%, and 1% was introduced into the molten salt electrolyzes. Magnesium chloride in an appropriate amount corresponding to the production amount of metal magnesium was charged into the electrolytic cell to perform fused salt electrolysis at an average current density of 0.48 $A/cm^2$. In this instance, the amount of the current which had flowed was 13.8 kA, and hence the theoretical production amount is 18.8 kg/h. However, the actual production amount was 16.0 kg/h, and therefore the current efficiency of the molten salt electrolyzer was 85%. The production amount per unit volume of the electrolysis chamber was 8.0 $kg/m^3 \cdot h$.

Comparative Example 2

Figure 5:
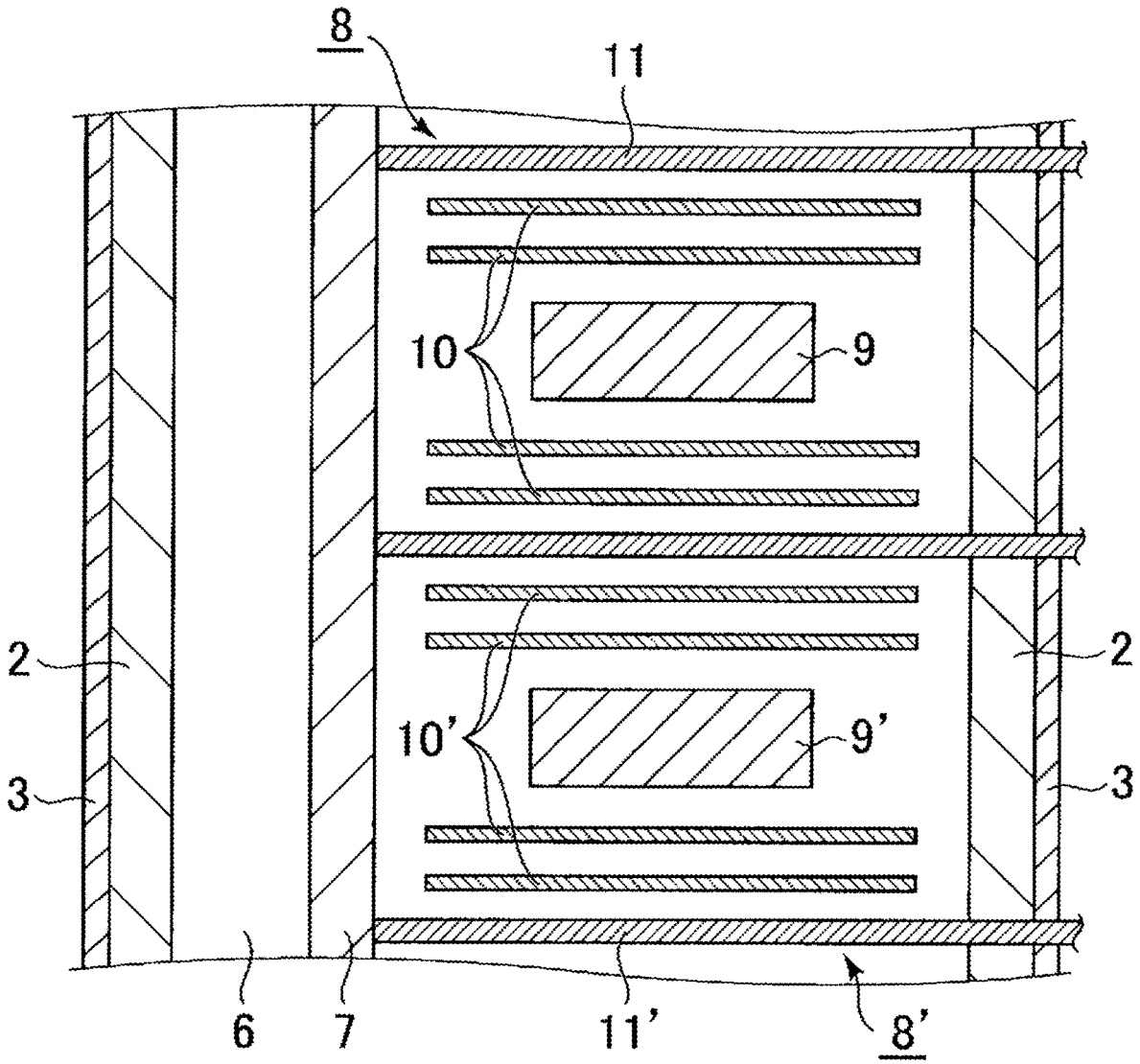
FIG. 5 is an explanatory view showing a horizontal cross-section of a molten salt electrolyzer used as a Comparative Example, which has disposed therein electrodes in a flat plate form.

As shown in FIG. 5, two sets of an anode, a bipolar electrode, and a cathode, which are in a flat plate form and conventionally used, were disposed in the molten salt electrolyzer shown in FIG. 2, and 2,800 kg of a fused salt comprising $MgCl_2$, $CaCl_2$, NaCl, and $MgF_2$ in the respective mass percentages of 20%, 30%, 49%, and 1% was introduced into the molten salt electrolyzer. Magnesium chloride in an appropriate amount corresponding to the production amount of metal magnesium was charged into the electrolytic cell to perform fused salt electrolysis at an average current density of 0.48 $A/cm^2$. The molten salt electrolyzer is substantially the same as the molten salt electrolyzer in Example 1 except that there is no electrode plane facing the wall side of the cathode and bipolar electrode. In this instance, the amount of the current which had flowed was 12.3 kA, and hence the theoretical production amount is 16.7 kg/h. However, the actual production amount was 13.9 kg/h, and therefore the current efficiency of the molten salt electrolyzer was 83%. The production amount per unit volume of the electrolysis chamber was 7.0 $kg/m^3 \cdot h$.

Example 3

After operating the molten salt electrolyzer for 5 days which was used in Example 1, in a stable condition, metal magnesium produced was extracted about 10 g from the top portion of the metal collection chamber without being contaminated with magnesium chloride, and cooled to solid at room temperature. After that metal magnesium produced was dissolved in hydrochloric acid (1+1), measured the concentration of Al in magnesium by using ICP-OES (SPS3100 (24H) made by HITACHI Hightech-Science). The extraction of the metal magnesium was performed in a stable condition after 5 days from the starting of operation. Without being varied the measured concentration, the extraction was performed 4 times every 2 hours, and an average SMA was calculated. The formula to calculate the average is as follows.

$$SMA=(P1+P2+P3+P4+P5)/5 \quad (1)$$

(P1~5:respective Al concentration in Mg measured after 0, 2, 4, 6, 8 hours)

The result is shown in Table 1.

Example 4

Experiment was performed at the same condition of Example 3, except using molten salt electrolyzer used in Example 2. The result is shown in Table 1.

Comparative Example 3

Experiment was performed at the same condition of Example 3, except using molten salt electrolyzer used in Comparative Example 1. The result is shown in Table 1.

Comparative Example 4

Experiment was performed at the same condition of Example 3, except using molten salt electrolyzer used in Comparative Example 2. The result is shown in Table 1.

TABLE 1

| example | Al concentration in metal Magnesium (ppm) |
|---|---|
| Example 3 | 38 |
| Example 4 | 37 |
| Comparative Example 3 | 42 |
| Comparative Example 4 | 102 |

INDUSTRIAL APPLICABILITY

The molten salt electrolyzer of the present invention is useful not only in the production of metal magnesium but also in the production of metal aluminum, metal calcium, metal zinc, and the like, and further, by incorporating the molten salt electrolyzer of the invention into the fusion electrolysis step for magnesium chloride in the production of a titanium sponge, it is possible to efficiently produce a titanium sponge at a low cost.

REFERENCE SIGNS LIST

1: Molten salt electrolyzer
5: Electrolysis chamber
6: Metal collection chamber
7: Barrier
8: Electrolytic cell
9: Anode
10: Bipolar electrode
11: Cathode

The invention claimed is:

1. A molten salt electrolyzer having a metal collection chamber and an electrolysis chamber, the molten salt electrolyzer having two or more electrolytic cell units in the electrolysis chamber, wherein each electrolytic cell unit has a cathode having a space in a prism form, an anode in a prism form, and at least one bipolar electrode in a rectangular cylinder form, wherein the bipolar electrode is disposed in an inner space of the cathode, and the anode being disposed in an inner space of the bipolar electrode, wherein at least part of individual planes forming an outer side of the rectangular cylinder of the bipolar electrode closest to the cathode faces a plane forming the prism-form space of the cathode, wherein at least part of individual planes forming an inner side of the rectangular cylinder of the bipolar electrode closest to the anode faces a plane forming the prism of the anode, wherein at least one plane of the cathode constitutes one plane of the cathode of another electrolytic cell unit, and wherein the anode is disposed to be shifted from a middle of a space surrounded by the cathode to a side opposite to the metal collection chamber.

2. The molten salt electrolyzer according to claim 1, wherein at least one of a distance between the cathode plane on the side opposite to the metal collection chamber and a bipolar electrode plane closest to the cathode plane, a distance between the bipolar electrode plane on the side opposite to the metal collection chamber and another bipolar electrode plane closest to the bipolar electrode plane, and a distance between the bipolar electrode plane on the side opposite to the metal collection chamber and an anode plane closest to the bipolar electrode plane is shorter than a distance between a corresponding cathode plane on the metal collection chamber side and the bipolar electrode plane closest to the cathode plane, a distance between a corresponding bipolar electrode plane on the metal collection chamber side and another bipolar electrode plane closest to the bipolar electrode plane, or a distance between the corresponding bipolar electrode plane on the metal collection chamber side and the anode plane closest to the bipolar electrode plane.

3. The molten salt electrolyzer according claim 1, wherein the anode has a horizontal cross-section in which a ratio of the long side and the short side is 1:1 to 10:1.

4. A method for producing metal magnesium, comprising subjecting magnesium chloride to fusion electrolysis using the molten salt electrolyzer according to claim 1 to produce metal magnesium.

5. A method for producing a titanium sponge, comprising reducing titanium tetrachloride using the metal magnesium obtained by the method according to claim 4 to produce a titanium sponge.

6. The molten salt electrolyzer according to claim 1, wherein a level of an electrolytic bath in the metal collection chamber is substantially the same as a level of an electrolytic bath in the electrolysis chamber, and wherein an upper end of the cathode is disposed to be lower than the level of the electrolytic bath in the metal collection chamber.

7. The molten salt electrolyzer according to claim 1, wherein materials for an inner wall and a barrier in the molten salt electrolyzer are at least one selected from a brick having an $Al_2O_3$ content of 90% or more, a brick having a $SiO_2$ content of 90% or more, a brick having a $Si_3N_4$ content of 90% or more, a brick having a MgO content of 90% or more, and a brick having a combination of at least two of $Al_2O_3$, $SiO_2$, $Si_3N_4$ and MgO content of 90% or more.

* * * * *